United States Patent [19]

Sedlacek

[11] Patent Number: 4,699,200

[45] Date of Patent: Oct. 13, 1987

[54] APPARATUS FOR CASTING METAL

[75] Inventor: Edward A. Sedlacek, Lower Burrell, Pa.

[73] Assignee: Aluminum Company of America, Pittsburgh, Pa.

[21] Appl. No.: 904,606

[22] Filed: Sep. 8, 1986

[51] Int. Cl.[4] ..... B22D 11/07

[52] U.S. Cl. ..... 164/268; 164/418; 164/472

[58] Field of Search ..... 164/418, 459, 267, 268, 164/472, 342, 137

[56] References Cited

U.S. PATENT DOCUMENTS

| | | | |
|---|---|---|---|
| 2,206,888 | 7/1940 | Greenidge | 164/472 |
| 3,087,213 | 4/1963 | Milliken et al. . | |
| 4,057,100 | 11/1977 | Lossack et al. | 164/418 |
| 4,157,728 | 6/1979 | Mitamura et al. | 164/472 X |
| 4,214,624 | 7/1980 | Foye et al. . | |
| 4,610,295 | 9/1986 | Jacoby et al. . | |

*Primary Examiner*—Kuang Y. Lin

*Attorney, Agent, or Firm*—Max L. Williamson

[57] ABSTRACT

Apparatus for casting metal which includes a mold having a central opening with a member attached to the top of the mold in concentric alignment therewith. Also included are at least three elements attached to the mold around the periphery of the member, which elements are selectively movable to be in or out of contact with the member, and when in contact, position the member in concentric alignment with the mold.

9 Claims, 10 Drawing Figures

APPARATUS FOR CASTING METAL

BACKGROUND OF THE INVENTION

This invention relates to apparatus for continuous or semicontinuous casting of molten metal into an ingot form.

In casting at least some metals, such as aluminum and alloys thereof, for example, the molten metal is poured into a mold having a bottom wall which is vertically movable. Typically, the sidewalls of the mold are short and situated at the top of a pit. When molten metal is flowed into the mold, it rapidly solidifies from the effect of a coolant, usually water, which is continuously sprayed on the mold exterior. The bottom wall or starting block is then lowered at a rate commensurate with the introduction of molten metal into the mold while a lubricant is continuously supplied to the interior sidewall surfaces of the mold to enhance lowering the ingot into the pit. Thus, a long ingot of metal is continuously produced. The supply of oil to lubricate between the interior of the mold and the solidified ingot surface is critical. In a method of providing oil, a continuous groove is cut in the top wall of the mold around the mold opening to function as a reservoir for oil. A plurality of slots are cut in the mold from the oil groove to the mold interior, and oil from the groove flows through the slots and down the interior mold surface. A cover plate or oil ring is fastened to the top surface of the mold over the oil reservoir groove in order to retain the oil therein. The inside dimensions of the oil ring are critical to insure that its assembly with the mold is suitable to enable lubrication of the mold and not interfere with the casting of the ingot.

The high temperatures incurred in molding cause the oil ring to expand but, heretofore, because of the manner of seating and attaching the oil ring to the mold, the periphery of the ring has been restrained against movement. Upon cooling to room temperature, the ring shrinks, and under some circumstances, it shrinks to an extent that it has lesser inside and outside dimensions than it had prior to being heated. If the mold is circular, for example, both the inside diameter and outside diameter decrease and the ring no longer fits properly with respect to the mold opening. In casting most aluminum alloys, water is used as a coolant and shrinkage of the oil ring has not been a major problem. In recent years, however, there has been an increasing interest in aluminum alloys having lithium as an alloying element, and ethylene glycol, rather than water, is often used as a coolant for safety reasons. For reasons that are not fully understood, the incidence of ring shrinkage has sharply increased when using ethylene glycol as a coolant. It is theorized that ethylene glycol is not as efficient as water for cooling, and the ring and other parts of the mold apparatus are thus used at a higher temperature level than when used with water. It is believed that this higher operating temperature adversely affects the shrinkage and expansion uniformity among the different parts of the casting mold package. For whatever reason, ring replacement is a problem when using ethylene glycol as a coolant in casting metal. It would be desirable to be able to reuse the ring by machining the ring interior an amount sufficient to increase the I.D. to its original value. Heretofore, however, there has been no practical way to reposition a machined ring with sufficient coaxial accuracy with respect to the mold to make it possible to salvage shrunken rings.

In addition to the problem created by shrinkage of the oil ring, molds can sometimes become deformed upon overheating. To use the mold, it has been necessary to either machine the mold to enable a concentric fit with an oil ring or hand fit the oil ring to the deformed mold. In either case, the salvage effort is time consuming and relatively costly.

SUMMARY OF THE INVENTION

A mold of apparatus of this invention has a recessed portion around the mold opening to function as a seat for an oil ring. With a proper ring and mold, the ring is coaxially aligned with the mold when it is seated snugly in the recess. To enable the use of an undersized ring, the mold includes at least three adjustable devices spaced around its periphery. By suitable adjustment of the devices, they are made to center the undersized ring in a concentric fit with the mold.

It is an objective of this invention to enable an undersized oil ring to be assembled concentrically with a metal mold.

It is also an objective of this invention to concentrically assemble an oil ring with a deformed metal mold.

It is a further objective to relieve or eliminate the restraint on the periphery of the ring so that it is free to expand during heating.

These and other objectives and advantages will become more apparent with the following description of a preferred embodiment of the invention and accompanying drawings.

DESCRIPTION OF A PREFERRED EMBODIMENT

A preferred embodiment of this invention is described as apparatus for casting an aluminum cylindrical extrusion billet. It is understood that the invention is not limited to use in casting aluminum nor to a mold for producing a cylindrical-shaped ingot.

Figure 1:
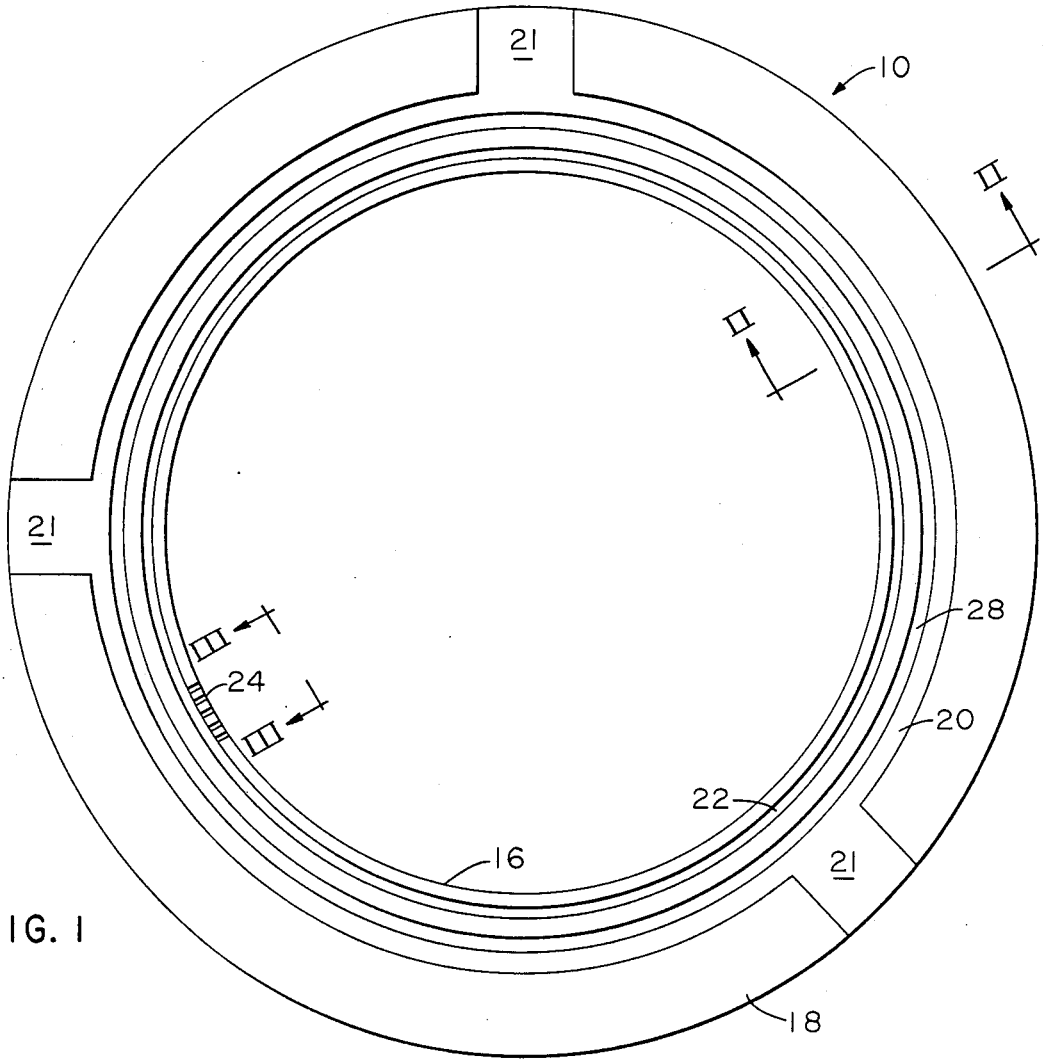
FIG. 1 is a plan view of a mold of apparatus of this invention.
Figure 3:
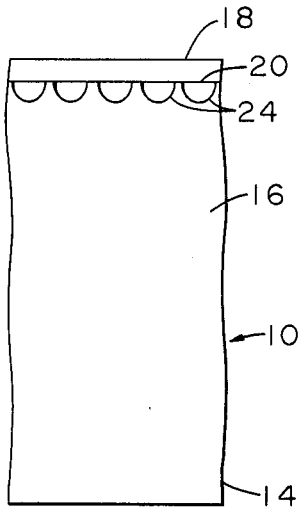
FIG. 3 is an elevation of a fragmentary portion of the inside of the mold shown in FIG. 1.
Figure 2:
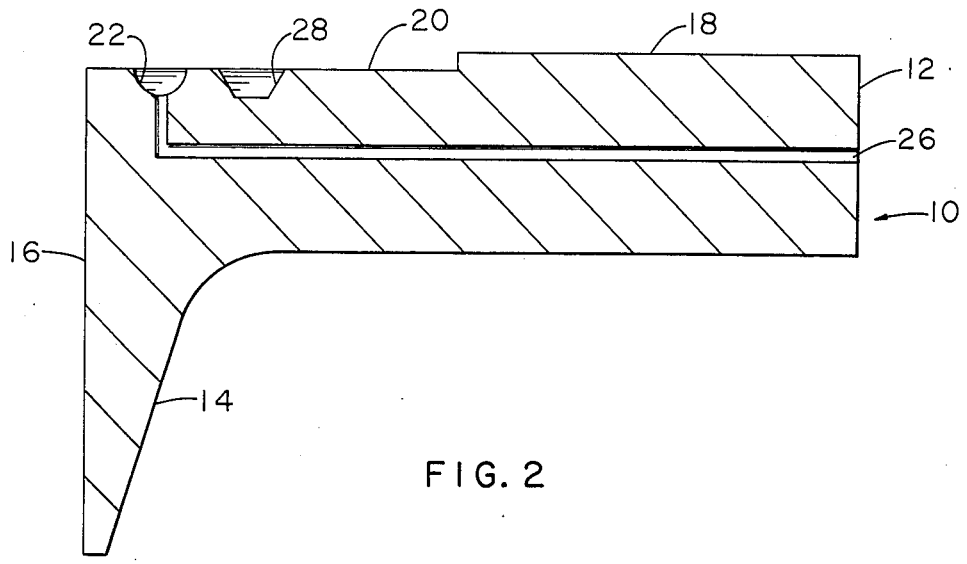
FIG. 2 is a sectional view of the mold shown in FIG. 1.
Figure 4:
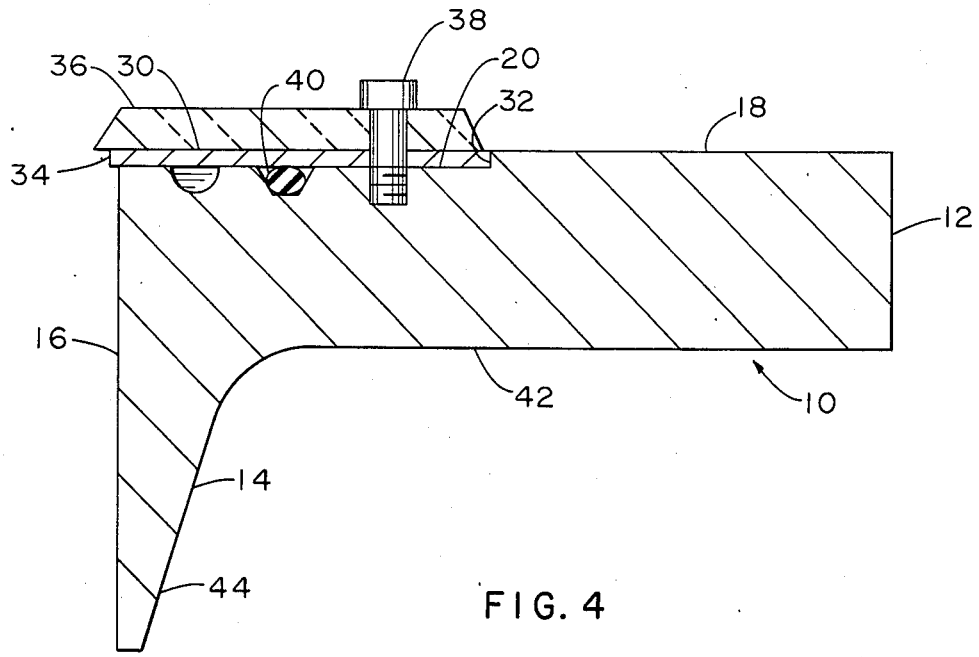
FIG. 4 is a sectional view of an assembly of the mold shown in FIG. 1 with an oil ring and a retainer ring.

The mold 10 of the apparatus has a ring-shaped upper portion 12 and a portion 14 depending therefrom along the inner face 16 of the mold which is triangular in cross section. Along the top surface 18 of the mold, an annular portion extending outwardly from the inner face 16 is machined away to form a recess 20 for seating an oil ring, as will be discussed later. At least three additional machined away recesses 21 are provided in the top wall 18 extending inwardly from the outer periphery of the mold to the oil ring recess 20. These additional recesses 21 are provided as seats for centering cams, as will be discussed later. A continuous annular groove 22 for carrying oil is adjacent the inner surface 16, and equally spaced slots 24 connecting the groove with the inner surface completely encircle the mold interior and provide passageways for oil to flow from the groove to the inner face of the mold, but only a portion of the slots 24 are shown in FIG. 1. One or more passageways 26 from an oil source (not shown) through the mold provide oil to the groove 22. A second annular groove 28 outward of the oil groove 22 functions as a seat for an "O" ring seal between an oil ring and mold assembly which will now be discussed with reference to FIG. 4.

The oil ring 30 is a closely machined ring which seats snugly in the recess 20. The recess shoulder 32 fits against the periphery of the ring 30 and centers it in coaxial alignment with the mold 10. For casting purposes, it is important that the inner surface 34 of the ring 30 project slightly inward into the mold interior so that it provides a slight lip with respect to the inner mold surface 16. Overlaying the oil ring 30 is another ring or cover 36 which is made of a heat resistant refractory material, such as an asbestos based material, for example. A plurality of bolts 38 extending through the rings 36, 30 into the mold 10 firmly hold the rings in place and compress an O ring 40 in the O ring seat groove between the oil ring 30 and mold 10 to effect an oil seal. The Maronite ring 36 is adapted in size to project slightly into the mold interior beyond the inner face of the oil ring 30.

The preferred embodiment of this invention as thus far described is typical of known casting apparatus of this type. The mold 10 is typically made of aluminum or copper, and the oil ring 30 of copper. In using the apparatus, a starting platform or block (not shown) is positioned at the base of the Maronite ring 36. The mold 10 and oil ring 30 assembly is preheated to a temperature below the melting point of aluminum. Molten metal is then introduced into the apparatus through the Maronite ring as the starting block is slowly lowered. A coolant, usually water, is flooded over the outer mold surfaces 42, 44, and as the molten metal contacts the oil ring 30, heat is rapidly carried away and the pool of molten metal begins to solidify from the outside inwardly. Before the starting block has dropped a distance less than the thickness of the oil ring 30, a solidified shell has formed around the molten metal. Concurrent with introducing molten metal into the apparatus, oil is caused to flow through the slots 24 and flood the inner surface 16 of the mold. Now it may be seen why it is important that the oil ring extend inwardly slightly from the inner surface of the mold. It is the I.D. of the oil ring 30 which sets the O.D. of the ingot being cast, provides clearance between the mold 16 and ingot as the ingot descends into the mold pit and enables flooding the space between the ingot and mold with lubricant. If the I.D. of the oil ring 30 is too great at any point around its periphery, the ingot may bind or damage the mold. It is evident, therefore, why the I.D. of the oil ring and concentricity with the mold is of such great importance.

Figure 5:
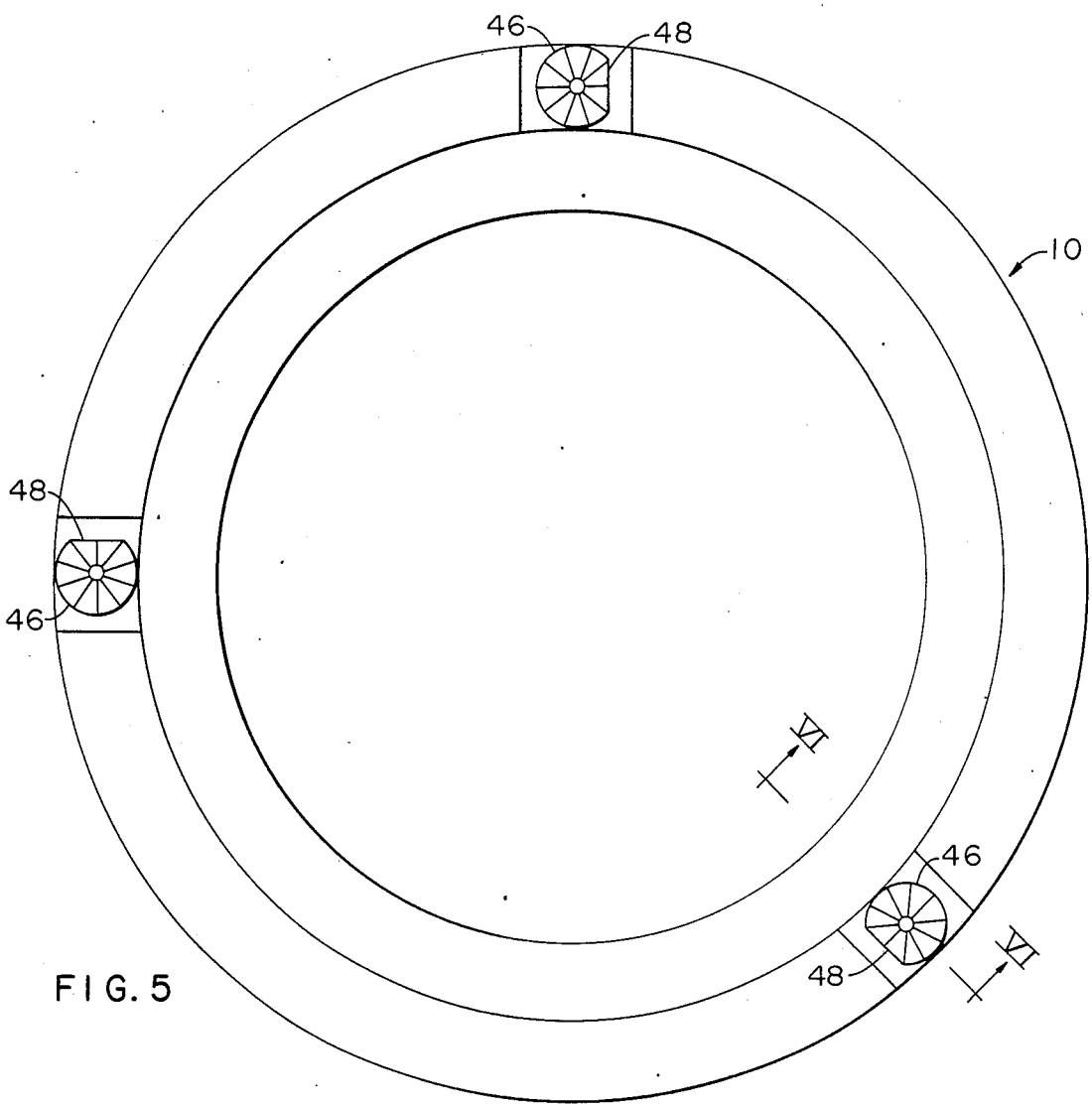
FIG. 5 is a plan view of apparatus of this invention showing cams for positioning an oil ring with respect to a mold.
Figure 6:
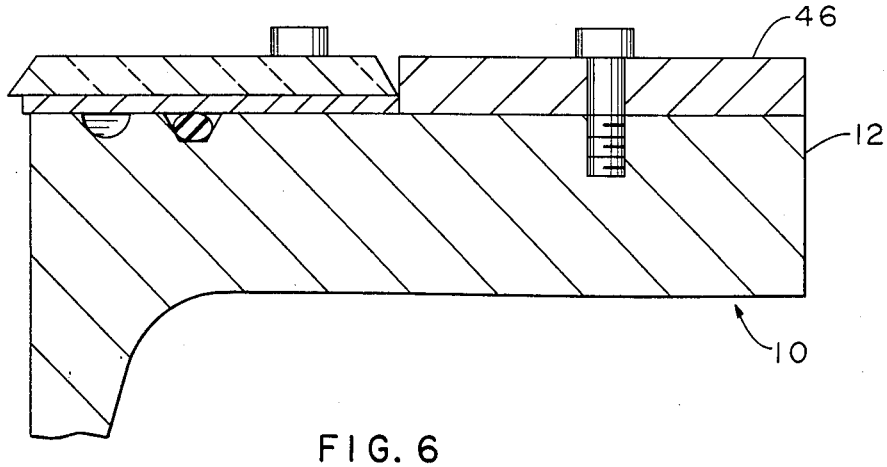
FIG. 6 is a sectional view of the apparatus shown in FIG. 5 showing the assembly of a mold, oil ring, oil ring seal, and cam for positioning the oil ring.

Apparatus of this invention enables simple and easy coaxial alignment of an undersized ring 30 with a mold 10 so that the ring can be machined to its original I.D., as will now be explained with reference to FIGS. 5 and 6. At least three centering cams 46 are rotatably fastened in recesses 21 machined in the mold top wall 18 adjacent the outer edge of the mold. The centering cams 46 are discs having an eccentric periphery interrupted by a flat portion 48. The planar surface is divided into a convenient number of angular segments such as the 10 shown in this preferred embodiment, for example. The radius of the disc 46 progressively increases from one end of the flat portion 48 to the other end thereof. Thus, the eccentric curved outer periphery of each of the cams 46 is an identical spiral. An identical system of numerals or other indexing marks are provided on the face of the cams 46, and each cam is attached on the identical annular line around the mold 10. The cams 46 are attached to the mold 10 in a position whereby the point of connection of one end of the flat portion 48 to the end of the spiral having the least radius is tangent to the annular line defined by the recess shoulder 32. Thus, if a correctly dimensioned ring 30 is positioned in the recess 20, the ring would fit snugly against the shoulder 32, and if all of the cams 46 were rotated so that the points marked number "1" were tangent to the shoulder line, the cams would contact the ring as well. If the ring 30 were undersized, however, it would not seat snugly in the recess 20, and consequently it could not be simply or easily coaxially aligned with the mold 10. In this instance, the cams 46 are rotated until all are in contact with the ring when rotated to identical positions. It may be seen that since the cams are identical, if all were in contact with the ring 30 at the numeral "3", for example, then the undersized ring would be in alignment. The ring 30 can then be clamped or bolted in this aligned position and the I.D. reduced until the ring projects beyond the inner surface 16 of the mold the correct distance. After the oil ring 30 has been repaired, the casting apparatus can be assembled by firmly bolting the Maronite and oil rings 36, 30 in place with the bolts 38. This is possible because the holes through the oil ring 30 are made sufficiently large to accommodate the bolt after repair of the ring. Once the apparatus has been fully assembled, the cams 46 are rotated until the flat surface 48 is again tangent with the shoulder recess 32 line and the ring 30 is then free to expand when heated up for use in casting ingot.

Figure 7:
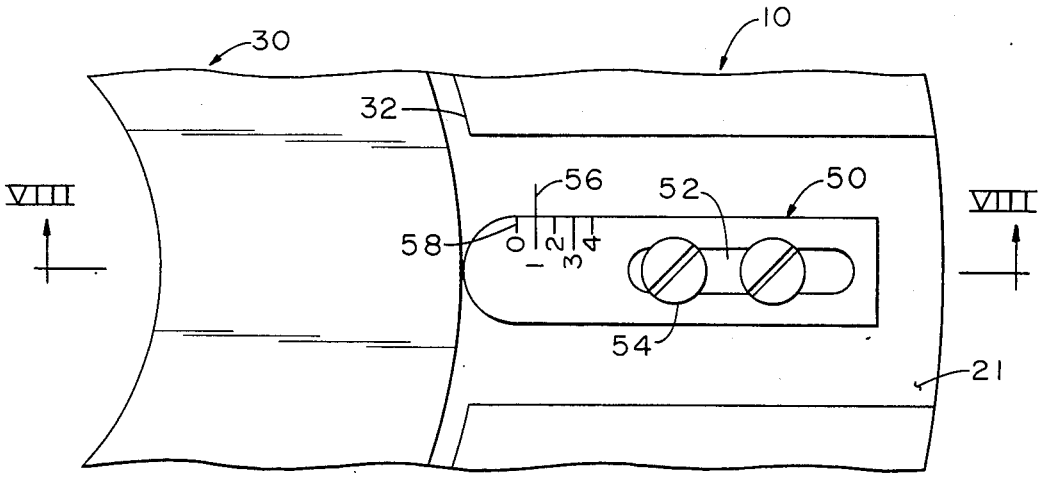
FIG. 7 is a plan view of a fragmentary portion of an alternate embodiment of apparatus of this invention showing a slidable bar for positioning an oil ring with respect to a mold.
Figure 8:
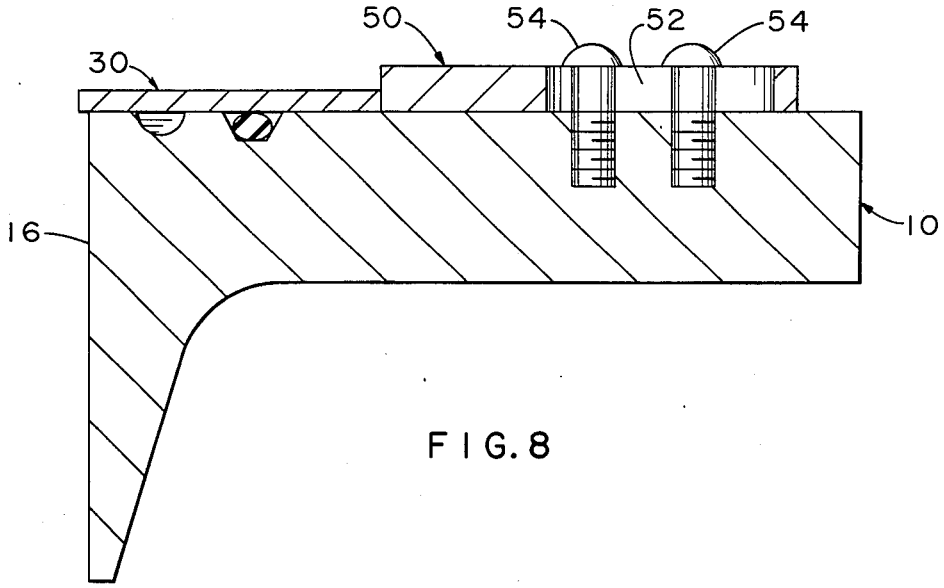
FIG. 8 is a sectional view of the embodiment shown in FIG. 7.

In an alternate embodiment of the invention, a sliding bar 50 as shown in FIGS. 7 and 8 rather than a cam can be used as a means of centering the ring. The bar 50 is positioned in the recess 21 in the mold with its longitudinal axis coincident with a radial line. It is fastened through a slotted opening 52 to be radially movable with a pair of screws 54. An index mark 56 is scribed or otherwise indicated in the bottom of the recess 21, and calibrations 58 are marked on the bar 50. Thus, if at least three sliding bars 50, identically marked and indexed in the same position around the periphery of the mold 10, are in contact with the oil ring 30 and each has the same calibration mark 58 in line with the mold index mark 56, the ring 30 will be in coaxial alignment with the mold.

Figure 9:
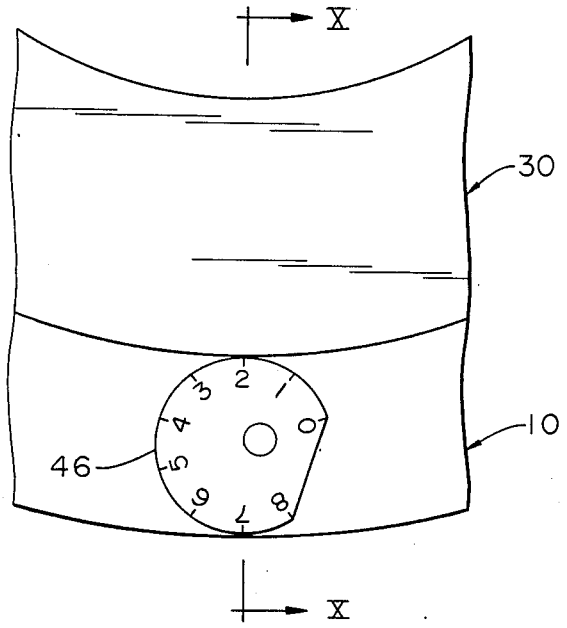
FIG. 9 is a plan view of an alternate embodiment of apparatus of this invention showing an oil ring in assembly with a mold having no recess.
Figure 10:
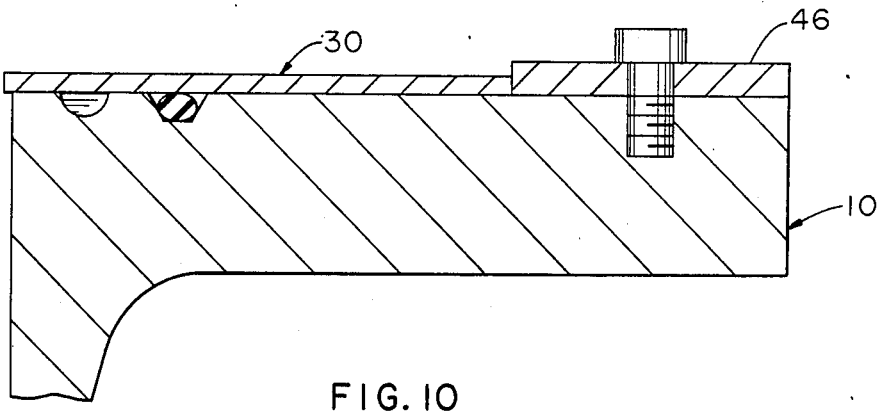
FIG. 10 is a sectional view of the embodiment shown in FIG. 9.

In yet another embodiment of the invention shown in FIGS. 9 and 10, the recess 21 is eliminated and the centering cams 46, sliding bars 50, or other suitable adjustable means are used to initially center and coaxially align the oil ring 30 with the mold 10. It is advantageous to use adjustable means of this invention to center and align the ring 30 because once the ring is correctly centered, it can be bolted in place in a manner that it is free to expand or contract with temperature changes. Even a new ring is free of outer restraint when using this embodiment of the invention.

While the invention has been described in terms of preferred embodiments, the claims appended hereto are intended to encompass all embodiments which fall within the spirit of the invention.

What is claimed is:

1. Apparatus for casting metal, comprising:

a mold having a central opening;

a member having a central opening of lesser inside dimensions than the mold central opening in coaxial assembly with the mold on a top surface thereof; and adjustable means on the mold adapted for movement to enable contacting the member and aligning the member in coaxial alignment with the mold by making such contact.

2. Apparatus as claimed in claim 1 wherein the central openings in the mold and member are circular and the member is a ring.

3. Apparatus as claimed in claim 1 wherein the means for positioning the member is cam means affixed to the mold in sufficient numbers and position around the periphery of the member to enable coaxially aligning the member with the mold by contacting the member with the cam means.

4. Apparatus as claimed in claim 3 wherein the cam means is an eccentric disc.

5. Apparatus as claimed in claim 1 wherein the means for positioning the member is a plurality of sliding bars affixed to the mold around the periphery of the member with the bars axially slidable along lines which pass through the mold axis.

6. Apparatus for casting metal, comprising:

a mold having a top surface, a circular central opening and an annular recess in the top surface extending outwardly from the central opening surface;

a ring having a lesser outside diameter than the recess diameter seated in the recess; and adjustable means on the mold adapted for movement to enable contacting the ring and for aligning the ring coaxially with the mold by making such contact.

7. Apparatus as claimed in claim 6 wherein the mold includes at least three outer recesses in the top surface extending outwardly from the annular recess to the mold's outer periphery and the means for aligning the ring is cam means in each of the outer recesses adapted to be selectively movable to contact or be out of contact with the ring and by such contact capable of coaxially aligning the ring with the mold.

8. Apparatus as claimed in claim 7 wherein the cam means is an eccentric disc.

9. Apparatus as claimed in claim 6 wherein the means for aligning the ring is a bar in each of the recesses having its longitudinal axis on a line passing through the mold axis and affixed for longitudinal sliding movement so that each of the bars can be slid into or out of contact with the ring and by contacting the ring is capable of coaxially aligning the ring with the mold.

* * * * *